United States Patent [19]

Aylward

[11] 4,052,230

[45] Oct. 4, 1977

[54] DEEP HARDENING MACHINABLE ALUMINUM KILLED HIGH SULFUR TOOL STEEL

[75] Inventor: Paul T. Aylward, Bethlehem, Pa.

[73] Assignee: Bethlehem Steel Corporation, Bethlehem, Pa.

[21] Appl. No.: 742,396

[22] Filed: Nov. 15, 1976

Related U.S. Application Data

[62] Division of Ser. No. 633,343, Nov. 19, 1975, Pat. No. 4,019,930.

[51] Int. Cl.[2] ..... C21D 9/48

[52] U.S. Cl. ..... 148/2; 148/12 F; 148/12.4

[58] Field of Search ..... 75/124, 126 C, 126 D, 75/126 P, 126 L; 148/2, 3, 12 F, 12.4, 36, 143

[56] References Cited

U.S. PATENT DOCUMENTS

| | | | |
|---|---|---|---|
| 1,919,211 | 7/1933 | Edlund | 75/126 L |
| 3,251,682 | 5/1966 | Wada et al. | 75/126 P |
| 3,544,393 | 12/1970 | Zanetti | 75/126 P |
| 3,600,158 | 8/1971 | Molnar et al. | 75/126 L |
| 3,876,422 | 4/1975 | Cantera et al. | 148/36 |
| 3,901,740 | 8/1975 | Anderson et al. | 75/123 B |

*Primary Examiner*—Arthur J. Steiner

*Attorney, Agent, or Firm*—Joseph J. O'Keefe; John J. Selko

[57] ABSTRACT

A low-alloy tool steel, for dies and molds, is deep hardening and highly machinable in the hardened condition. The steel is a water-quenched composition containing boron, sulfur, at least 0.020% aluminum, and a minimum of hardening agents including chromium and molybdenum. The method of producing such steel is disclosed.

3 Claims, 4 Drawing Figures

DEEP HARDENING MACHINABLE ALUMINUM KILLED HIGH SULFUR TOOL STEEL

This is a division of application Ser. No. 633,343, filed Nov. 19, 1975, now U.S. Pat. No. 4,019,930.

BACKGROUND OF THE INVENTION

Medium and low-alloy tool steels, known as mold steels, are used to make molds for injection plastic molding and zinc die casting. Such steels are usually supplied prehardened. By prehardened I mean that the steel is hardened before the machining of the die cavity takes place, so that the mold can be placed directly into service after the cavity is machined.

Such prehardened mold steels are usually supplied as billets, plates, or bars, and must have a combination of deep hardenability and high machinability in the hardened condition.

Two currently supplied steels for these applications are AISI P20 and another prior art steel referred to herein as "Mold Steel". The aim analyses of these steels are listed in Table I.

Table I

| | Type Steel | |
|---|---|---|
| | Mold Steel | P-20 |
| C | .47 | .30 |
| | .55 | .37 |
| Mn | .75 | .70 |
| | 1.25 | .90 |
| P | .025 Maximum | .025 Maximum |
| S | .06 | 0.25 Maximum |
| | .13 | |
| Si | .20 | .35 |
| | .35 | .55 |
| Cr | .80 | 1.55 |
| | 1.25 | 1.75 |
| Mo | .15 | .35 |
| | .25 | .42 |
| B | .0005 Minimum | None |

Because of its carbon content, Mold Steel is not water quenchable; it must be oil quenched, which means that this steel cannot be supplied prehardened from a modern plate mill which employs water quenching. Quenching must be performed in an oil bath which is a separate operation and therefore an added expense. Also Mold Steel, while it is resulphurized, would be a better product if it had higher machinability in the hardened condition. The P-20 steel has the advantage that it is hardenable by water quenching. However, because of its low sulphur content, prehardened P-20 exhibits a machinability that is even lower than Mold Steel. Also, P-20 is relatively expensive to produce because of the high chromium and molybdenum levels necessary to achieve the desired hardenability.

It is well known that boron can be used to replace some of the chromium and molybdenum for hardening, provided that elements such as aluminum and titanium are present to protect the boron. However, it is widely believed that deoxidation with aluminum decreases the machinability of a resulfurized steel because hard aluminum oxide particles are formed and these particles accelerate tool wear. Also, the aluminum changes the sulfide from globular to a stringer-type sulfide concentrated at grain boundaries, and this change also decreases machinability. The negative effects of aluminum on machinability are documented in such publications as "The Making, Shaping and Treating of Steel", Ninth Edition, Page 1286, and U.S. Pat. Nos. 3,424,576 and 3,600,158 to Fogleman et. al. and Molnar et. al., respectively.

There is a need for a steel which is deeply hardenable by water quenching, which is inexpensive to produce because it has a minimum of alloying agents for hardenability, and which is highly machinable in the hardened condition.

SUMMARY OF INVENTION

I have discovered a steel which possesses the desired combination of properties. My steel is a hot worked water-quenched product having a composition with a broad and preferred range as follows:

Table II

| | Broad | Preferred |
|---|---|---|
| C | .33 | .33 |
| | .42 | .38 |
| Mn | .70 | 1.00 |
| | 1.25 | 1.25 |
| P | .025 max. | .025 max. |
| S | .03 | .03 |
| | .110 | .110 |
| Si | .15 | .20 |
| | .45 | .40 |
| Al | .020 min. | .020 min. |
| Cr | .90 | 1.10 |
| | 1.85 | 1.35 |
| Mo | .10 | .15 |
| | .50 | .25 |
| B | — | .0005 min. |
| Ti | — | .010 min. |

The balance is iron with impurities which can include residual amounts of Ni up to 0.25% and Cu up to 0.035. All percentages herein are weight percent.

The steel in its preferred embodiment is produced by a unique and critical combination of composition and process. By hot working, that is, hot rolling or forging billets, plates or bars of the particular composition followed with water quenching and tempering, I provide a steel which exhibits a tolerance for aluminum without decreasing machinability in the hardened condition. It permits the substitution of boron for a portion of the chromium and molybdenum.

DESCRIPTION OF PREFERRED EMBODIMENTS

Figure 1:
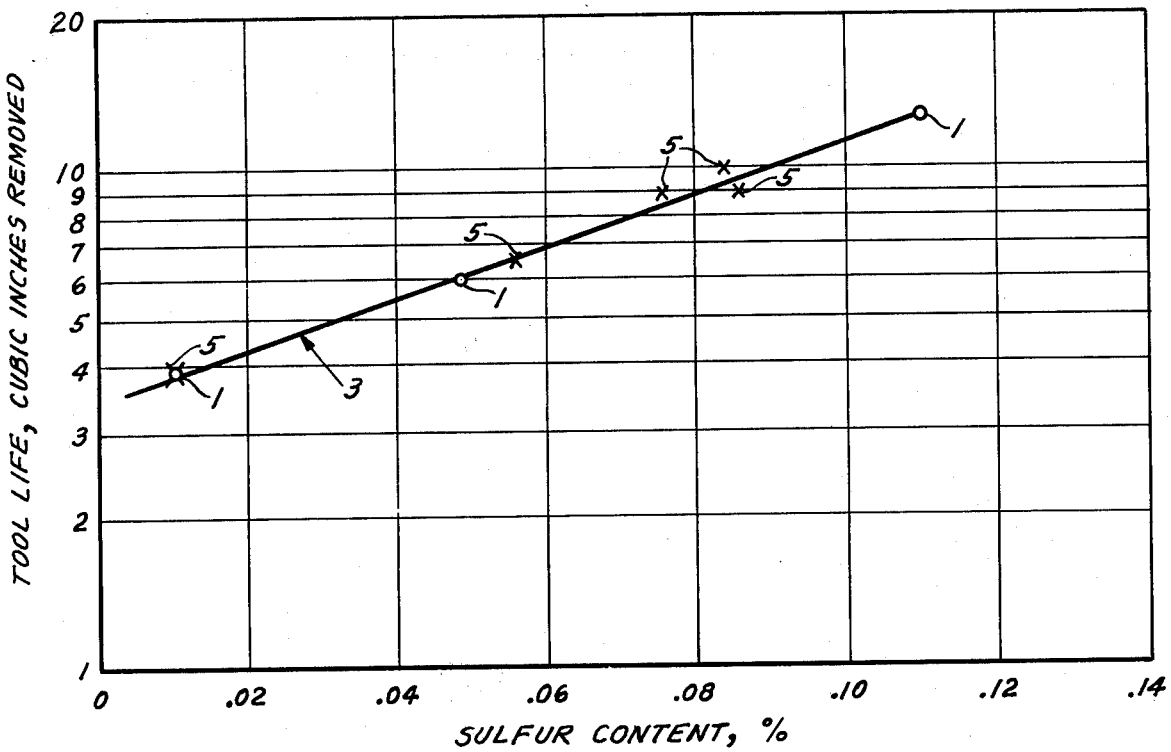
FIG. 1 is plot of tool life in cubic inches removed versus sulfur for the steel of Example I.

The preferred embodiments will be described by the following Examples:

EXAMPLE I

Several samples of commercially supplied Mold Steel and standard AISI P-20, prehardened to about 300 Brinell, were obtained for machinability comparisons with the steels of this invention. A series of base steels similar to P-20 were modified with various amounts of sulphur and aluminum contents. The compositions of all steels are listed in Table III. Aluminum contents herein are total aluminum.

TABLE III

| Steel Type | Code | Quench Type | C | Mn | P | S | Si | Ni | Cr | Mo | Cu | Al | Ti | Other |
|---|---|---|---|---|---|---|---|---|---|---|---|---|---|---|
| P-20 | 342 | * | .38 | .86 | .009 | .010 | .38 | .14 | 1.49 | .38 | .063 | .031 | .004 | N/A |
| P-20 | P20-OQ | ** | .35 | .77 | .003 | .009 | .61 | .13 | 1.72 | .42 | .050 | .007 | .003 | N/A |
| P-20 | Nat-1 | ** | .36 | .86 | .004 | .006 | .22 | .10 | 1.00 | .49 | .075 | <.005 | <.003 | .18V |
| P-20 | 504 | * | .36 | .76 | .007 | .009 | .37 | .08 | 1.59 | .32 | .053 | .045 | <.003 | N/A |
| P-20 | 489 | * | .37 | .86 | .006 | .010 | .41 | .08 | 1.64 | .30 | .050 | .039 | <.003 | N/A |
| Mold Steel | SSP | ** | .50 | .99 | .011 | .055 | .33 | .14 | .97 | .21 | .051 | .043 | .004 | .001B |
| Mold Steel | TAR | ** | .05 | 1.00 | .009 | .075 | .34 | .20 | .99 | .21 | .070 | .046 | .004 | .002B |
| Invention | A | * | .41 | .82 | .013 | .011 | .43 | .15 | 1.83 | .44 | .053 | <.005 | N/A | N/A |
| Invention | F | * | .37 | .74 | .011 | .011 | .43 | .16 | 1.83 | .46 | .057 | .033 | N/A | N/A |
| Invention | E | * | .37 | .71 | .009 | .049 | .44 | .14 | 1.65 | .47 | .052 | .007 | N/A | N/A |
| Invention | D | * | .37 | .86 | .016 | .056 | .42 | .13 | 1.73 | .38 | .058 | .019 | N/A | N/A |
| Invention | G | * | .36 | .74 | .015 | .076 | .31 | .12 | 1.43 | .44 | .057 | .030 | N/A | N/A |
| Invention | H | * | .36 | .77 | .013 | .084 | .44 | .12 | 1.65 | .37 | .061 | .077 | N/A | N/A |
| Invention | C | * | .37 | .87 | .015 | .086 | .45 | .12 | 1.68 | .45 | .056 | .048 | N/A | N/A |
| Invention | B | * | .38 | .74 | .011 | .110 | .47 | .13 | 1.69 | .41 | .056 | .003 | N/A | N/A |

* = Water Quench + Temper.
** = Oil Quench + Temper.N/A = Nothing Added

Billet samples from the invention steels representing the mid-section of ingots, were water quenched from an austenitizing temperature of 1650° F. by immersion in water that is agitated in a tank having ¾ inch submerged nozzles spraying water at 100 psi. Immediately after quenching, the steels were tempered at approximately 1000° to 1200° F. for a period of two hours per inch of thickness, followed by cooling in air. The goal of the hardening procedure was to achieve a nominal hardness of 300 Brinell, i.e. a hardness from surface to center of a 4 inch to 6 inch thick billet, within the range of 285/321 Brinell.

All steels were tested for machinability. The test consisted of removing, in a peripheral end milling operation, consecutive layers of steel, each layer being defined by the length and width of the surface of the specimen. The machining began near the specimen's surface and progressed through the thickness toward the center of the section. The machining conditions and results are contained in Table IV.

TABLE IV

| Steel Type | Code | Quench Type | Sulfur Content % | Aluminum Content % | Tool Life(1) Tool Minutes | Tool Life(1) Cu. In. Removed | Brinell Hardness |
|---|---|---|---|---|---|---|---|
| P-20 | 342 | * | .010 | .031 | 18.0 | 2.1 | 331 |
| P-20 | P20-OQ | ** | .009 | .007 | 22.0 | 2.6 | 302 |
| P-20 | P20-OQW | * | .009 | .007 | 30.5 | 3.6 | 302 |
| P-20 | Nat-1 | ** | .006 | <.005 | 26.6 | 3.1 | 285 |
| P-20 | 504 | * | .009 | .045 | 32.4 | 3.8 | 285 |
| P-20 | 489 | * | .010 | .039 | 30.0 | 3.5 | 277/285 |
| Mold Steel | SSP | ** | .055 | .043 | 36.7 | 4.3 | 311 |
| Mold Steel | TAR | ** | .075 | .046 | 44.6 | 5.3 | 285 |
| Invention | A | * | .011 | <.005 | 33.1 | 3.9 | 302 |
| Invention | F | * | .011 | .033 | 33.0 | 3.9 | 302 |
| Invention | E | * | .049 | .007 | 51.5 | 6.0 | 302 |
| Invention | D | * | .056 | .019 | 55.5 | 6.5 | 311 |
| Invention | G | * | .076 | .030 | 76.0 | 8.9 | 311 |
| Invention | H | * | .084 | .077 | 84.7 | 9.9 | 302 |
| Invention | C | * | .086 | .048 | 76.5 | 9.0 | 311 |
| Invention | B | * | .110 | .003 | 107.3 | 12.6 | 302 |

* = Water Quench +Temper.
** = Oil Quench + Temper.

(1)MILLING CONDITIONS

Milling Cutter: ½ in. dia., 2 flute, high speed steel end mill
Cutting Speed: 66 fpm
Depth of Cut: 0.125 inch
Width of Cut: 0.187 inch
Rate of feed: .005 inch per tooth
Coolant: dry
Tool Life End Point: 0.010 inch average; peripheral-flank wearland.

FIG. 1 shows a plot of machinability versus sulphur. The machinability is defined as the cubic inches of metal removed for the life of a tool. The life of a tool for the purposes of this test was defined as 0.010 inch average peripheral land wear on the tool. These definitions are well known to those skilled in the art.

Referring again to FIG. 1 three points, identified by the number 1, establish the line 3 which is the machinability of the base P-20 with no aluminum and modified with varying amounts of sulphur.

The prior art teaches that the addition of varying amounts of aluminum to a resulfurized steel analysis will decrease machinability because of the presence of hard aluminum oxides, and a change in the nonmetallic sulfide characteristics. Thus, the machinability line for a resulfurized steel deoxidized with aluminum should be below line 3.

However, I have discovered that, unexpectedly, for this water quenched steel, that the prior art is wrong; aluminum does not decrease machinability at all. Points 5 plot the machinability of the modified P-20 base steel at various sulphur levels, with aluminum up to 0.077 weight percent. As FIG. 1 shows; these points fall almost exactly on line 3, establishing the proposition that for a steel which is water quenched and tempered to the hardness of about 300 Brinell, aluminum can be present in amounts varying between 0.003% to 0.077% without decreasing the steel's machinability. I believe that the water quenching contributes to the machinability by providing a very uniform microstructure of martensite, as compared to an oil quenched structure which includes more bainite.

The unexpected discovery that aluminum can be present in the hardened steel without decreasing machinability has significant implications. It means that, for hardening, boron can be substituted for at least a portion of the expensive chromium and molybdenum without decreasing machinability. This effect is proven by Example II.

EXAMPLE II

A series of steels of modified base P-20 composition, having different amounts of aluminum, sulphur, chromium, and molybdenum and boron were prepared and tested according to the procedure of Example 1. Table V summarizes the chemical analysis.

TABLE V

| Steel Type | Code | Quench Type | C | Mn | P | S | Si | Ni | Cr | Mo | Cu | Al | Ti | B |
|---|---|---|---|---|---|---|---|---|---|---|---|---|---|---|
| Invention | 69 | * | .39 | .98 | .009 | .018 | .24 | .11 | 1.29 | .20 | .093 | .020 | .015 | .001 |
| Invention | 70 | * | .40 | 1.21 | .008 | .013 | .24 | .13 | 1.08 | .22 | .120 | .020 | .014 | .001 |
| Invention | 63 | * | .35 | 1.25 | .012 | .013 | .28 | .12 | 1.42 | .23 | .051 | .065 | .026 | .002 |
| Invention | 66 | * | .39 | .87 | .014 | .018 | .20 | .12 | .91 | .21 | .056 | .020 | .015 | .001 |
| Invention | 85 | * | .39 | 1.06 | .016 | .031 | .27 | .11 | 1.58 | .20 | .053 | .033 | .017 | .002 |
| Invention | 67 | * | .36 | 1.10 | .013 | .048 | .27 | .12 | 1.23 | .23 | .055 | .017 | .035 | .002 |
| Invention | 1B3 | * | .34 | 1.13 | .011 | .053 | .36 | .12 | 1.13 | .20 | .030 | .036 | .025 | .001 |
| Invention | 14 | * | .42 | 1.24 | .012 | .062 | .43 | .11 | .64 | .12 | .062 | <.005 | <.010 | N/A |
| Invention | 13 | * | .39 | 1.45 | .013 | .068 | .29 | .10 | .62 | .12 | .022 | <.005 | <.010 | N/A |
| Invention | 17 | * | .36 | .95 | .013 | .078 | .19 | .12 | 1.81 | .13 | .063 | .031 | <.010 | .001 |
| Invention | 16 | * | .45 | 1.20 | .013 | .083 | .34 | .11 | 1.13 | .24 | .062 | .036 | <.010 | .001 |
| Invention | 62 | * | .34 | .87 | .014 | .089 | .16 | .12 | 1.09 | .21 | .055 | .020 | .023 | .001 |

* Water Quench + Temper.
N/A = None Added

Figure 2:
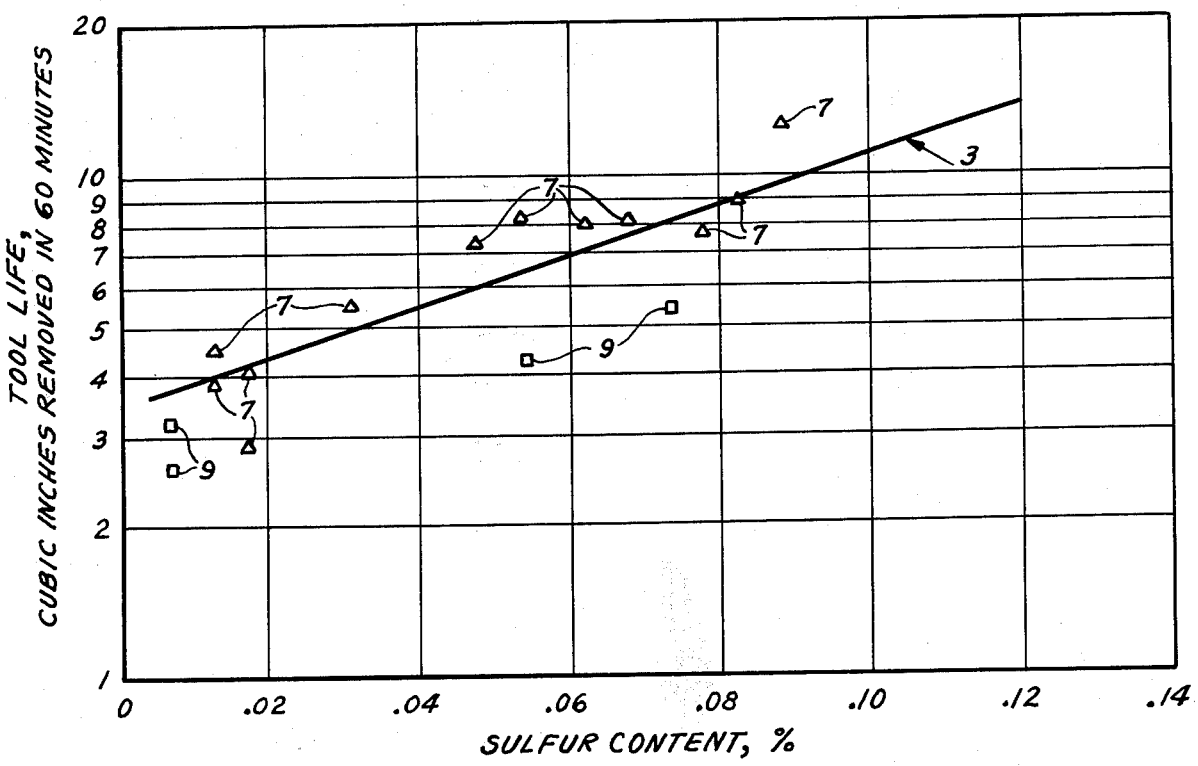
FIG. 2 is a plot of tool life in cubic inches removed versus sulfur for the steel of Examples I and II.

FIG. 2 shows the machinability curve 3 established for steel of Example I. Machinability data 7 from table VI for the steel of Example II fall very close to the same line, allowing for some scatter due to the large number of chemistry variables.

TABLE VI

| Steel Type | Code | Quench Type | Sulfur Content % | Aluminum Content % | Tool Life: Tool[1] Minutes | Tool Life: Cu. In.[1] Removed | Tool Life: Cu. In. Removed[2] (60 Min.) | Brinell Hardness |
|---|---|---|---|---|---|---|---|---|
| Invention | 69 | * | .018 | .020 | 24.5 | 2.9 | ** | 302/311 |
| Invention | 70 | * | .013 | .020 | 32.0 | 3.8 | ** | 311/320 |
| Invention | 63 | * | .013 | .065 | 40.2 | 4.7 | 2.8 | 285/293 |
| Invention | 66 | * | .018 | .020 | 34.6 | 4.1 | ** | 293/311 |
| Invention | 85 | * | .031 | .033 | 47.4 | 5.5 | 3.6 | 302 |
| Invention | 67 | * | .048 | .017 | 63.0 | 7.4 | 7.8 | 285/302 |
| Invention | 1B3 | * | .053 | .036 | 70.5 | 8.3 | 8.9 | 311 |
| Invention | 14 | * | .062 | <.005 | 68.0 | 8.0 | 8.2 | 302/311 |
| Invention | 13 | * | .068 | <.005 | 69.2 | 8.1 | 7.9 | 302/321 |
| Invention | 17 | * | .078 | .031 | 65.8 | 7.7 | 7.8 | 302/311 |
| Invention | 16 | * | .083 | .036 | 75.5 | 8.9 | 8.7 | 311 |
| Invention | 62 | * | .089 | .020 | 109.0 | 12.8 | 13.2 | 285/302 |

* = Quench + Temper.
** Cannot be calculated from available data.
[1]Machining Conditions of Example I
[2]Calculated from test data obtained at feed rates from .003- .010 inch per tooth.

FIG. 2 establishes that a low alloy steel containing boron, aluminum and sulphur, if water-quenched and tempered will exhibit good machinability in the hardened condition.

Tool life for oil-quenched P-20 and Mold Steel from Table IV are plotted on FIG. 2 and are identified as points 9. FIG. 2 shows that the steels of the invention exhibit about 40% to 50% improved machinability. The steels of the invention are more economical to produce than P-20, due to lower alloy costs, and most economical than Mold Steel due to the ability to be water-quenched, thus eliminating oil quenching.

Figure 3:
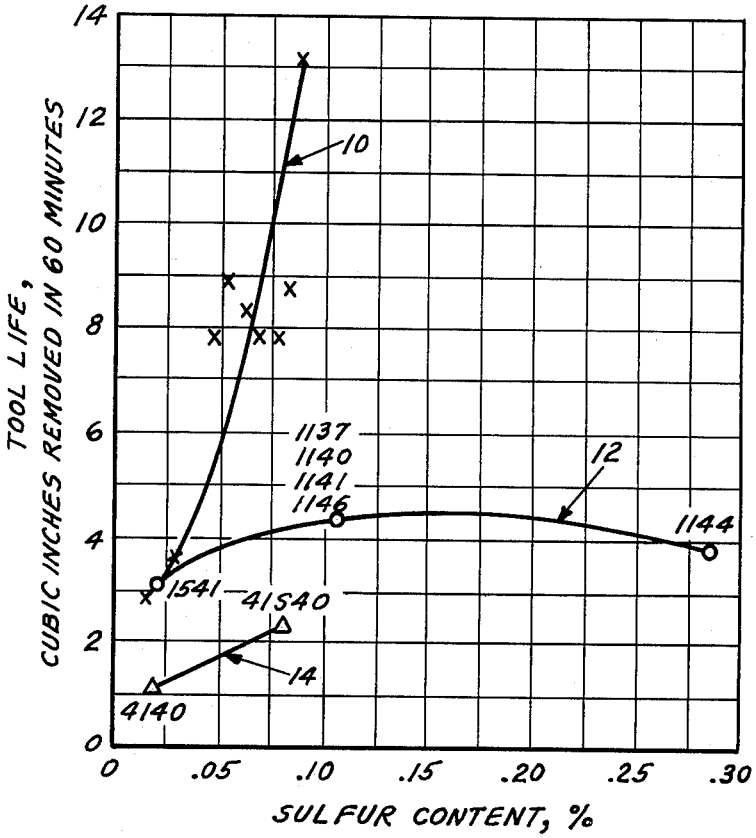
FIG. 3 is plot of tool life in cubic inches removed in 60 minutes versus sulfur for the steel of the invention and various prior art steels.

FIG. 3 shows another unexpected result; the water quenched steels of Example II respond to increasing amounts of sulphur by increasing their machinability at an increasing rate, as indicated by the slope of line 10.

The prior art teaches the opposite; as sulphur increases, the improvement of machinability should increase, but at a slower or decreasing rate. Curve 12 of FIG. 3 illustrates this effect for a series of steel of medium carbon content in the cold drawn condition at a hardness of about 200 Brinell. The points for curve 12 were calculated from published machinability data listed in the commonly used reference "Machining Data Handbook", Metcut Research Associates, Inc., Second Ed., 1972, Section 1.11, Library of Congress, Cat. Card No. 66-60051. Anyone skilled in the art could perform the calculations, using the data in the reference handbook.

Next to the points of curve 12 are typical AISI steel grades which behave as the curve 12 indicates. The sulphur for each AISI grade was taken to be the midpoint of the AISI sulphur aim range.

Since the reference lists machining conditions which permit calculation of tool life defined as cubic inches of metal removed in 60 minutes, the data from the experimental steels were recalculated to place them on the same basis, and are listed in TABLE VI.

Line 14 plots a similar calculation for a medium carbon, oil-quenched steel hardened to about 300 Brinell. Again, as the slope of curve 14 indicates, improvement in machinability does not increase at an increasing rate, as it does in curve 10 as indicated by the slope of curve 10. Also, the machinability of the steel of this invention is significantly higher than the oil quenched steels plotted in curve 14.

EXAMPLE III

A heat of steel having the preferred analysis range of Table VII was produced commercially and water-quenched and tempered to several hardness ranges.

TABLE VII

| | Heat 124N618VLD |
|---|---|
| C | .35 |
| Mn | 1.13 |
| P | .010 |
| S | .051 |
| Si | .37 |
| Ni | .11 |
| Cr | 1.16 |
| Mo | .21 |
| Al | .038 |
| Ti | .023 |
| B | .0009 |

Figure 4:
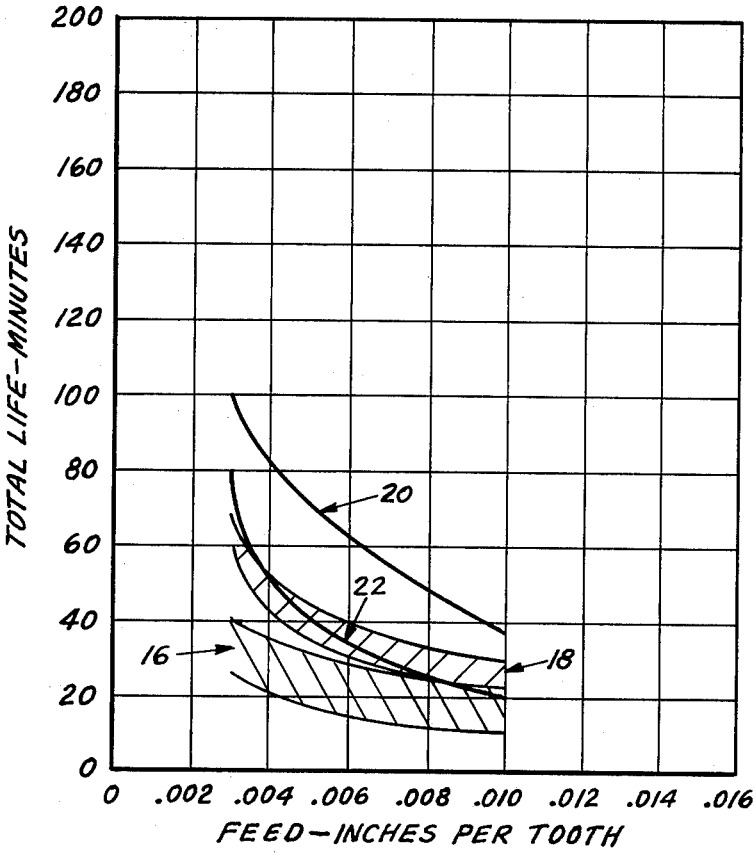
FIG. 4 is a plot of tool life in minutes versus sulfur for the steel of the invention and P-20 and Mold Steel.

FIG. 4 plots the tool life of the steel of the invention as compared to the typical tool life provided by both Mold Steel and standard P-20. Referring to FIG. 4, the range of tool life for standard P-20 hardened to about 285 to 331 Brinell is shown by shaded portion 16. Typical tool life for Mold Steel, in the hardness range 285 to 311 Brinell is shown by shaded portion 18. Curve 20, the tool life for the steel of the invention, at the same hardness levels as P-20 and Mold Steel (302HB), is shown to be significantly higher than either Mold Steel or P-20.

On the other hand, the steel of the invention can be hardened to hardness levels significantly higher than those attainable by either Mold Steel or P-20 and still have machinability comparable to both Mold Steel and P-20. In FIG. 4, curve 22 shows the machinability for the steel of the invention after it has been water-quenched and tempered to a hardness of about 363 Brinell. This hardness level is significantly higher than the hardness levels for either Mold Steel or P-20. However, curve 22 shows the machinability of the steel of the invention to be fully equal to Mold Steel and better than P-20.

The significance of this fact is that the steel of the invention can be supplied at a much higher hardness level without a loss in machinability. Therefore, dies which are made from the steels of this invention can be machined as readily as Mold Steel or P-20, but will last much longer in operation due to their significantly higher hardness.

Therefore, the steel of this invention is a unique and critical combination of both composition and process. When the composition is supplied as a hot worked billet, plate, or bar in the water-quenched condition, the steel exhibits a good machinability, a tolerance for aluminum which permits the use of hardening agent such as boron in place of expensive chromium and molybdenum, and a significantly improved machinability. The final hardness of the steel, as is well known, can be adjusted by changing the tempering conditions.

I claim:

1. A method of producing a low alloy, aluminum killed, water-quenched, resulfurized, martensitic deep hardening steel, highly machinable in the hardened condition comprising:

a. providing an ingot of a composition consisting essentially of by weight:
Carbon — 0.33 to 0.42%
Manganese — 0.70 to 1.25%
Phosphorus — 0.025% maximum
Sulfur — 0.03 to 0.110%
Silicon — 0.15 to 0.45%
Aluminum — 0.019 to 0.077%
Chromium — 0.90 to 1.85%
Molybdenum — 0.10 to 0.50%
boron and titanium in amounts to effect hardening of said steel, said boron and titanium being present in amounts of at least 0.0005 and 0.010 weight percent, respectively and the balance iron with residual impurities;

b. hot working said ingot to form a hot worked product;

c. water-quenching said hot worked product from an austenitizing temperature; and d. tempering said water-quenched hot worked product to a desired hardness.

2. The invention of claim 1 in which said austenitizing temperature is about 1650° F.

3. The invention of claim 2 in which said tempering is done at about 1000° to 1200° F for a period of 2 hours per inch of thickness followed by cooling in air.

* * * * *